US009959849B2

(12) United States Patent
Abe et al.

(10) Patent No.: US 9,959,849 B2
(45) Date of Patent: May 1, 2018

(54) DRUM

(71) Applicant: YAMAHA CORPORATION, Hamamatsu-shi (JP)

(72) Inventors: Banri Abe, Hamamatsu (JP); Ryuji Hashimoto, Hamamatsu (JP); Keita Miyazaki, Sagamihara (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days. days.

(21) Appl. No.: 15/329,836

(22) PCT Filed: Sep. 7, 2015

(86) PCT No.: PCT/JP2015/075294
§ 371 (c)(1),
(2) Date: Jan. 27, 2017

(87) PCT Pub. No.: WO2016/043075
PCT Pub. Date: Mar. 24, 2016

(65) Prior Publication Data

US 2017/0263222 A1 Sep. 14, 2017

(30) Foreign Application Priority Data

Sep. 16, 2014 (JP) ..... 2014-187723

(51) Int. Cl.
*G10D 13/02* (2006.01)

(52) U.S. Cl.
CPC ..... *G10D 13/022* (2013.01); *G10D 13/02* (2013.01); *G10D 13/025* (2013.01)

(58) Field of Classification Search
CPC ..... G10D 13/022; G10D 13/02; G10D 13/025
(Continued)

(56) References Cited

U.S. PATENT DOCUMENTS 3,635,119 A * 1/1972 Thompson ..... G10D 13/02 84/411 M
4,226,156 A * 10/1980 Hyakutake ..... G10H 3/146 84/411 M
(Continued)

FOREIGN PATENT DOCUMENTS

JP 2004012987 A 1/2004
JP 3156059 U 12/2009
(Continued)

OTHER PUBLICATIONS

Written Opinion issued in International Application No. PCT/JP2015/075294 dated Nov. 24, 2015. Form PCT/ISA/237. English translation provided.
(Continued)

*Primary Examiner* — David Warren
*Assistant Examiner* — Christina Schreiber
(74) *Attorney, Agent, or Firm* — Rossi, Kimms & McDowel LLP

(57) ABSTRACT

A drum, including: a shell; at least one head; and a vibration damping portion including at least one of (a) an outer-surface facing surface which is disposed in substantially parallel with and is closely opposed to an outer surface of an outer peripheral portion of the at least one head without contacting the outer surface and (b) an inner-surface facing surface which is disposed in substantially parallel with and is closely opposed to an inner surface of the outer peripheral portion of the at least one head without contacting the inner surface.

8 Claims, 8 Drawing Sheets

(58) Field of Classification Search
USPC ..... 84/415
See application file for complete search history.

(56) References Cited

U.S. PATENT DOCUMENTS 4,519,288 A * 5/1985 Aluisi ..... G10D 13/022 84/411 M
4,567,807 A * 2/1986 Robinson ..... G10D 13/022 84/411 M
4,589,323 A * 5/1986 Belli ..... G10D 13/029 84/411 M
5,159,139 A * 10/1992 Beals ..... G10D 13/027 84/414
5,398,583 A * 3/1995 Cook ..... G10D 13/022 84/411 M
5,675,099 A * 10/1997 Granatello ..... G10D 13/02 84/411 M
5,844,157 A * 12/1998 Kasha ..... G10D 13/025 84/411 R
5,877,440 A * 3/1999 Chaffee ..... G10D 13/022 84/411 M
5,892,168 A * 4/1999 Donohoe ..... G10D 13/022 84/411 M
6,043,420 A * 3/2000 Arnold ..... G10D 13/022 84/411 M
6,215,053 B1 * 4/2001 Adinolfi ..... G10D 13/027 84/411 R
6,245,979 B1 * 6/2001 Campbell ..... G10D 13/022 84/411 M
6,291,754 B1 * 9/2001 Gatzen ..... G10D 13/022 84/411 M
6,525,249 B1 * 2/2003 Suenaga ..... G10D 13/022 84/104
6,686,526 B2 * 2/2004 Ezbicki ..... G09B 15/06 84/411 R
D611,524 S * 3/2010 Lawrence, III ..... D17/22
8,148,619 B1 * 4/2012 May ..... G10D 13/022 84/411 M
8,173,886 B2 * 5/2012 Hashimoto ..... G10D 13/024 84/411 R
8,253,001 B1 * 8/2012 Liu ..... G10D 13/02 84/411 R
8,916,759 B2 * 12/2014 Hashimoto ..... G10D 13/027 84/411 R
9,190,040 B2 * 11/2015 Hashimoto ..... G10D 13/027
9,349,356 B2 * 5/2016 Yoshino ..... G10D 13/027
9,396,712 B1 * 7/2016 Dunnett ..... G10D 13/027
9,520,113 B2 * 12/2016 Vermillion ..... G10D 13/021
2002/0096035 A1 * 7/2002 Good ..... G10D 13/022 84/414
2003/0136244 A1 * 7/2003 Okumura ..... G10D 13/027 84/411 R
2004/0025663 A1 * 2/2004 Harada ..... G10D 13/024 84/104
2006/0021495 A1 * 2/2006 Freitas ..... G10H 3/10 84/723
2006/0249005 A1 * 11/2006 Rush ..... G10D 13/028 84/411 R
2006/0249006 A1 * 11/2006 Whittington ..... G10D 13/022 84/415
2009/0013850 A1 * 1/2009 Abe ..... G10D 13/021 84/411 R
2010/0083812 A1 * 4/2010 Peavey ..... G10D 13/021 84/411 R
2012/0174732 A1 * 7/2012 Martinazzi ..... G10D 13/021 84/411 R
2014/0069256 A1 * 3/2014 Hashimoto ..... G10D 13/027 84/414
2014/0069257 A1 * 3/2014 Hashimoto ..... G10D 13/027 84/414
2015/0059554 A1 * 3/2015 Yoshino ..... B29D 7/00 84/414
2015/0243266 A1 * 8/2015 May ..... G10D 13/022 84/421
2017/0263222 A1 * 9/2017 Abe ..... G10D 13/022

FOREIGN PATENT DOCUMENTS

JP 2010266639 A 11/2010
JP 2016180966 A * 10/2016
WO WO 2016038408 A1 * 3/2016 ..... G10D 13/201

OTHER PUBLICATIONS

International Search Report issued in International Application No. PCT/JP2015/075294 dated Nov. 24, 2015. Form PCT/ISA/210. English translation provided.
International Preliminary Report on Patentability issued in International Application No. PCT/JP2015/075294 dated Mar. 21, 2017. Form PCT/IB/373.

* cited by examiner

DRUM

TECHNICAL FIELD

The present invention relates to a drum, such as a snare drum, including a shell and a batter head.

BACKGROUND ART

In an instance where sound produced by striking a head of an acoustic drum, such as a snare drum, is sustained too long, the sound of the acoustic drum is mixed with sound produced by other percussion instruments and accordingly becomes difficult to listen to. For permitting the sound produced by the acoustic drum to easily listen to or for suppressing sound of unnecessary components, the head is provided with extraneous matter for vibration damping (muting). For instance, a mute ring is placed on the head or a tape or gel for muting is attached to the head. Further, felt is put on a back surface of the head from inside of the shell or on a front surface of the head from outside of the shell. As disclosed in the following Patent Literature 1, there is known a configuration in which a casing has a support portion for supporting a mute ring or the like.

CITATION LIST

Patent Literature

Patent Literature 1: U.S. Pat. No. 5,675,099
Patent Literature 2: U.S. Patent Application Publication No. 2010/0083812

SUMMARY

Technical Problem

In the conventional muting methods, the extraneous matter is held in contact with the head. In this case, vibration of the head is excessively damped, and even sound necessary for rich tone color is undesirably damped. In particular, rich harmonics and tonal brightness are sacrificed due to muting, and rise (attack) of sound tends to become dull. The tone color at the time of rise is very important for percussion instruments and has a great influence on overall tone color of struck sound of the drum. In the muting method in which the extraneous matter is attached to the head, it is sometimes not easy to remove the extraneous matter from the head.

A drum disclosed in the Patent Literature 2 includes plate-shaped resonators provided on an inner surface of a shell. In the disclosed drum, the resonators are provided not for vibration damping but for resonating with the head.

The present invention has been developed to solve the conventionally experienced problems described above. It is therefore an object to provide a drum capable of suppressing a high-frequency component of struck sound so as to improve tone color.

Solution to Problem

To attain the object indicated above, a drum according to the present invention includes: a shell (91); at least one head (101, 102); and a vibration damping portion (11, 21, 31, 41; S) including at least one of (a) an outer-surface facing surface (11*a*, 31*a*) which is disposed in substantially parallel with and is closely opposed to an outer surface (101*a*, 102*a*) of an outer peripheral portion of the at least one head without contacting the outer surface and (b) an inner-surface facing surface (21*a*, 41*a*; Sa) which is disposed in substantially parallel with and is closely opposed to an inner surface (101*b*, 102*b*) of the outer peripheral portion of the at least one head without contacting the inner surface.

Preferably, one of the at least one head is a batter head, and the vibration damping portion is provided for the outer peripheral portion of the batter head. Preferably, one of the at least one head is a resonance head, and the vibration damping portion is provided for the outer peripheral portion of the resonance head.

Preferably, the vibration damping portion includes the inner-surface facing surface (Sa) provided at a bent portion of the shell located at one end portion of the shell that defines an opening of the shell. Preferably, the vibration damping portion has a continuous or intermittent substantially annular shape in plan view.

Preferably, the drum further includes an attachment (94, 95) which is provided on the shell and to which a snare wire (97) is attached, and the vibration damping portion provided for the resonance head is located in a region of the resonance head in its circumferential direction, which region does not include a position of the snare wire in a state in which the snare wire is attached to the attachment. Preferably, the inner-surface facing surface (21*a*, 41*a*; S) of the vibration damping portion is opposed to the inner surface (101*b*, 102*b*) of the outer peripheral portion of the at least one head at a position located radially inward of a distal end of an opening portion of the shell that defines an opening of the shell.

The reference signs in the brackets are for illustrative purpose.

Advantageous Effects

According to the drum constructed as described above, it is possible to suppress the high-frequency component of the struck sound so as to improve tone color.

The drum constructed as described above requires a reduced number of components and allows easy formation of the vibration damping portion. Further, the high-frequency component is efficiently suppressed, and an effect of suppressing the high-frequency component of the struck sound is enhanced. Moreover, it is possible to obtain sound by the snare wire while vibration of the resonance head is damped.

DESCRIPTION OF THE EMBODIMENTS

Figure 1A:
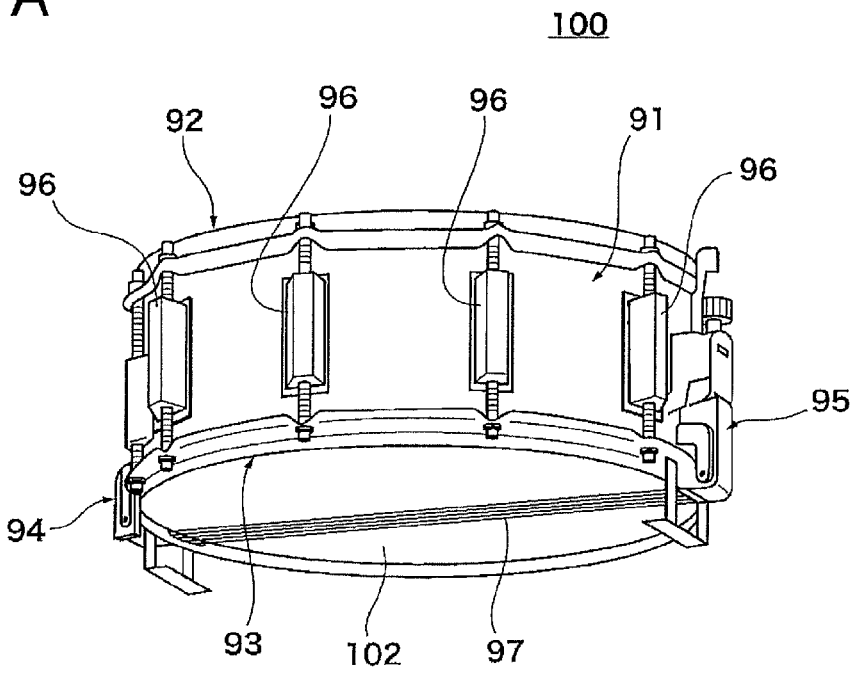
FIG. 1A is a perspective view of a snare drum according to one embodiment of the present invention and FIG. 1B is a fragmentary elevational view in vertical cross section of an upper portion of the snare drum.

Referring to the drawings, there will be hereinafter explained one embodiment of the present invention.

Figure 1B:
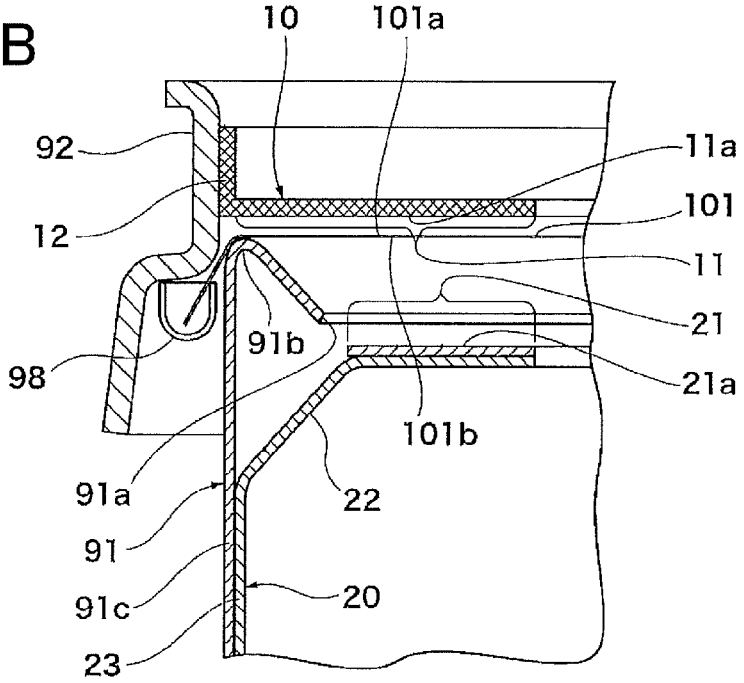

FIG. 1A is a perspective view of a drum according to one embodiment of the present invention. In the present embodiment, the drum is a snare drum 100. FIG. 1B is a fragmentary elevational view in vertical cross section of an upper portion of the snare drum 100.

The snare drum 100 includes a shell 91 having a cylindrical portion 91*c*. A batter head 101 and a resonance head 102 are respectively disposed at one and the other of opposite open ends of the cylindrical shell 91. When hereinafter referring to an up-down direction with respect to the snare drum 100, the up-down direction is defined with respect to a posture of the snare drum 100 in a state in which the batter head 101 is located above the resonance head 102. A front or upper surface of the batter head 101, i.e., an outer surface 101*a* of the batter head 101, is a striking surface. A plurality of lugs 96, each of which is formed in one piece, are fixed on an outer circumferential surface of the shell 91 so as to be equally spaced apart from one another. An annular hoop 92 is provided at the one of the opposite open ends of the shell 91 at which the batter head 101 is disposed, and an annular hoop 93 is provided at the other of the opposite open ends of the shell 91 at which the resonance head 102 is disposed.

An outer circumferential edge of the batter head 101 is coupled to a flesh hoop 98 (FIG. 1B) to keep a round shape of the batter head 101 in plan view. The flesh hoop 98 is held in engagement with the hoop 92, and tension of the batter head 101 is adjusted by adjusting tightening of tuning bolts of the lugs 96. The resonance head 102 similarly keeps a round shape in vertically symmetrical relation to the batter head 101, as shown in FIG. 2B.

Figure 2A:
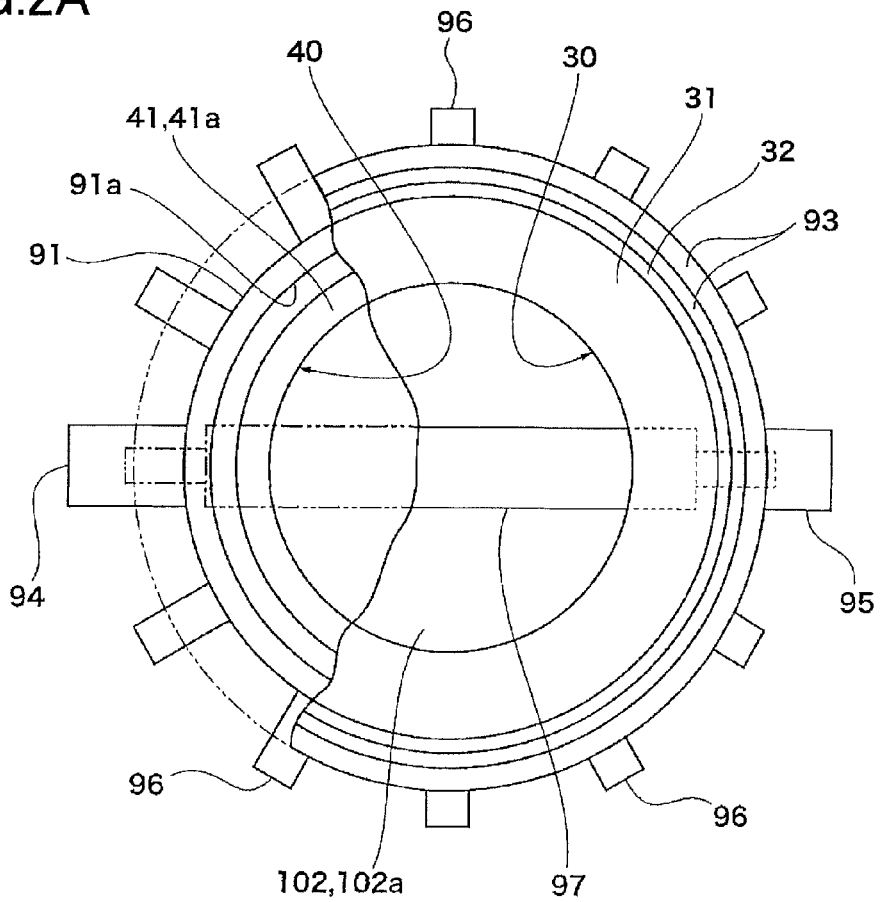
FIG. 2A is a bottom plan view of the snare drum and FIG. 2B is a fragmentary elevational view in vertical cross section of a lower portion of the snare drum.
Figure 2B:
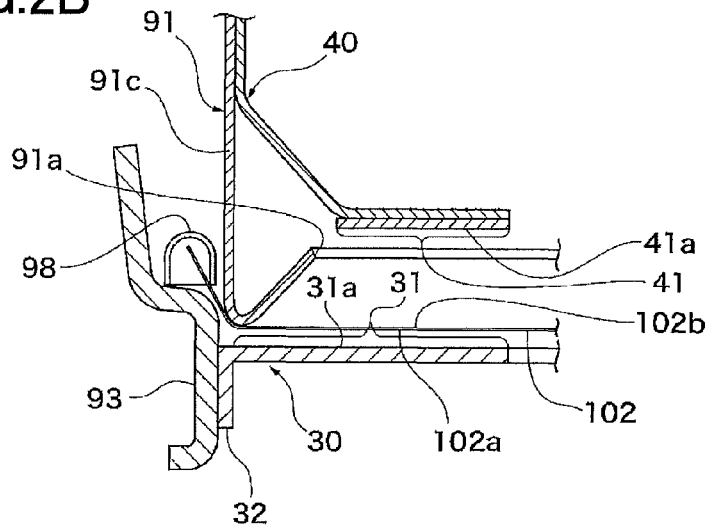

FIG. 2A is a bottom plan view of the snare drum 100 in which the resonance head 102 and the hoop 93 are partially cut away. FIG. 2B is a fragmentary elevational view in vertical cross section showing a lower portion of the snare drum 100.

As shown in FIGS. 1A and 2A, a snare wire 97 is usually provided on a front or lower side of the resonance head 102. The snare wire 97 is a snare for a drum. A pair of snare wire attachments 94, 95 are fixed to the outer circumferential surface of the shell 91 at diametrically opposite positions. The snare wire attachments 94, 95 include stationary-side and movable-side strainers and disposed at positions at which the lugs 96 are not provided. The snare wire 97 is attached at its opposite ends to the respective snare wire attachments 94, 95 and is stretched so as to be selectively brought into contact with and away from a front surface of the resonance head 102, i.e., an outer surface 102*a* of the resonance head 102.

The shell 91 is formed of a metal member. As shown in FIG. 1B, an upper end portion of the cylindrical portion 91*c* is bent inward at a bent portion 91*b*. A distal end portion of the inwardly bent portion is an end portion of the shell 91 and defines a circular opening portion 91*a*. The lower portion of the shell 91 is similarly formed in vertically symmetrical relation to the upper portion of the shell 91, as shown in FIG. 2B.

The snare drum 100 of the present embodiment includes vibration damping portions as constituent components not known in the art. The vibration damping portion has a vibration damping function of moderately suppressing mainly a high-frequency component of sound produced by striking the head and is provided for enhancing tone color without sacrificing tone color at the time of rise too much. Referring mainly to FIGS. 1B, 2A, and 2B, there will be explained examples of disposition and structure of the vibration damping portion.

A vibration damping portion 11 is provided so as to correspond to the outer surface 101*a* of the batter head 101, and a vibration damping portion 21 is provided so as to correspond to a back surface of the batter head 101, i.e., an inner surface 101*b* of the batter head 101. A vibration damping portion 31 is provided so as to correspond to the outer surface 102*a* of the resonance head 102, and a vibration damping portion 41 is provided so as to correspond to a back surface of the resonance head 102, i.e., an inner surface 102*b* of the resonance head 102. Each of the vibration damping portions 11, 21, 31, 41 is a part of a corresponding one of a first member 10, a second member 20, a third member 30, and a fourth member 40.

As shown in FIG. 1B, the first member 10 is fixed to an inner circumferential surface of the upper hoop 92. A vertical attaching portion 12 of the first member 10 is attached to the inner circumferential surface of the hoop 92 by bonding, screwing or the like. A flange portion extends from a lower part of the attaching portion 12 in a horizontal and radially inward direction. The flange portion functions as the vibration damping portion 11. A lower surface of the vibration damping portion 11, i.e., an outer-surface facing surface 11*a* of the vibration damping portion 11, is disposed substantially parallel with and is closely opposed to the outer surface 101*a* of an outer peripheral portion of the batter head 101 without contacting the outer surface 101*a*. The vibration damping portion 11 has an annular shape in plan view.

The second member 20 is fixed to the cylindrical portion 91*c* of the shell 91. A vertical attaching portion 23 of the second member 20 is attached to an inner circumferential surface of the cylindrical portion 91*c* by bonding, screwing or the like. An inclined portion 22 extends obliquely upward from an upper part of the attaching portion 23, and a horizontal portion that extends in the horizontal and radially inward direction from a distal end of the inclined portion 22 is folded back. The folded-back portion functions as the vibration damping portion 21. An upper surface of the vibration damping portion 21, i.e., an inner-surface facing surface 21*a* of the vibration damping portion 21, is disposed substantially parallel with and is closely opposed to the inner surface 101*b* of the outer peripheral portion of the batter head 101 without contacting the inner surface 101*b*, via the opening portion 91*a*. In other words, as shown in FIG. 1B, the inner-surface facing surface 21*a* of the vibration damping portion 21 is closely opposed to the inner surface 101*b* of the outer peripheral portion of the batter head 101 at a position located radially inward of a distal end of the opening portion 91*a* of the shell 91. The vibration damping portion 21 has an annular shape in plan view.

The third member 30 and the fourth member 40 are similarly disposed in vertically symmetrical relation to the first member 10 and the second member 20. That is, as shown in FIGS. 2A and 2B, a vertical attaching portion 32 of the third member 30 is attached to an inner circumferential surface of the lower hoop 93. A flange portion extends from an upper part of the attaching portion 32 in the horizontal and radially inward direction. The flange portion functions as the vibration damping portion 31. An upper surface of the vibration damping portion 31, i.e., an outer-surface facing surface 31*a* of the vibration damping portion 31, is disposed substantially parallel with and is closely opposed to the outer surface 102*a* of an outer peripheral portion of the resonance head 102 without contacting the outer surface 102*a*. The fourth member 40 has a folded-back portion that functions as the vibration damping portion 41. A lower surface of the vibration damping portion 41, i.e., an inner-surface facing surface 41*a* of the vibration damping portion 41, is disposed substantially parallel with and is closely opposed to the inner surface 102*b* of the outer peripheral portion of the resonance head 102 without contacting the inner surface 102*b*. In other words, as shown in FIG. 2B, the inner-surface facing surface 41*a* of the vibration damping portion 41 is closely opposed to the inner surface 102*b* of the outer peripheral portion of the resonance head 102 at a position located radially inward of the distal end of the opening portion 91*a* of the shell 91. Each of the vibration damping portions 31, 41 has an annular shape in plan view. The snare wire 97 is disposed above the vibration damping portion 31 so as to be in contact with the resonance head 102. It is noted that opposite end portions of the snare wire 97 may be disposed on an outer or lower side of the vibration damping portion 31.

A preferable shape of the vibration damping portion will be explained taking the vibration damping portion 11 as a representative example. The vibration damping portion 11 is shaped like a plate. The vibration damping portion is configured to have the facing surface (the outer-surface facing surface 11*a*) that is opposed to the outer surface 101*a* of the outer peripheral portion of the batter head 101. In this respect, the outer-surface facing surface 11*a* is located as close as possible to the batter head 101 while being spaced therefrom such that the outer-surface facing surface 11*a* does not contact the batter head 101 both of when the batter head 101 is struck and when the batter head 101 is not struck. Further, a clearance is left between the outer-surface facing surface 11*a* and the outer surface 101*a* of the batter head 101 without any other member interposed therebetween. An appropriate distance between the outer-surface facing surface 11*a* and the outer surface 101*a* of the batter head 101 is held within a range from several millimeters (mm) to several centimeters (cm). For higher vibration damping effect, the distance is preferably equal to or smaller than 15 mm.

There will be explained a region in the radial direction of the batter head 101 in which the vibration damping portion 11 is disposed. The vibration damping portion 11 is disposed such that the outer-surface facing surface 11*a* is located in a region corresponding to the outer peripheral portion of the batter head 101. The outer-surface facing surface 11*a* may be formed so as to be opposed to the outer surface 101*a* of the batter head 101 to its radially outermost end. Where a position that is radially inward of the radially outermost end of the batter head 101 by several millimeters (mm) is defined as a limit position, a position of an outer edge of the annular outer-surface facing surface 11*a* is preferably located radially outward of the limit position. If the position of the outer edge of the outer-surface facing surface 11*a* is located radially inward of the limit position, there is a risk that the high-frequency component cannot be suppressed. A position of an inner edge of the annular outer-surface facing surface 11*a* is preferably located radially outward of a position corresponding to a distance of half the radius of the batter head 101. If the position of the inner edge is located radially inward of the position corresponding to the distance of half the radius of the batter head 101, not only the high-frequency component, but also the low-frequency component may be largely influenced. Consequently, the region in the radial direction of the batter head 101 in which the outer-surface facing surface 11*a* is disposed preferably has a width (i.e., a width in the radial dimension) smaller than half the radius of the batter head 101.

For each of other vibration damping portions 21, 31, 41, the distance with respect to the corresponding one of the inner surface 101*b* of the batter head 101 and the outer and inner surfaces 102*a*, 102*b* of the resonance head 102 and the region in the radial direction (including the width) are similar to those of the vibration damping portion 11.

The vibration damping portion is formed of metal, for instance. The vibration damping portion may be formed of resin, wood, felt, corrugated cardboard, sponge, or the like. As long as the vibration damping portion has the facing surface such as the outer-surface facing surface 11*a*, the vibration damping portion may have a large thickness in the up-down direction, and portions thereof other than the facing surface may have any shape. In the configuration of the vibration damping portion (such as selection of the material and the shape, design of the distance with respect to the corresponding head, and design of the region in the radial direction in which the damping portion is disposed), it is essential that the vibration damping portion exhibit the function of damping the vibration of the head. A configuration in which the damping portion resonates with the vibration of the head is excluded.

FIGS. 3A to 3F are schematic views for explaining modes of membrane vibration of the drum. Consideration will be made taking vibration of the batter head 101 as an example of the membrane vibration of the round drum. In the vibration of the batter head 101, a multiplicity of vibration nodes exist, and a multiplicity of vibration antinodes accordingly exist. Thus, superimposition of a multiplicity of vibrations constitutes overall vibration of the batter head 101.

Figures 3A, 3B, 3C, 3D, 3E, 3F:
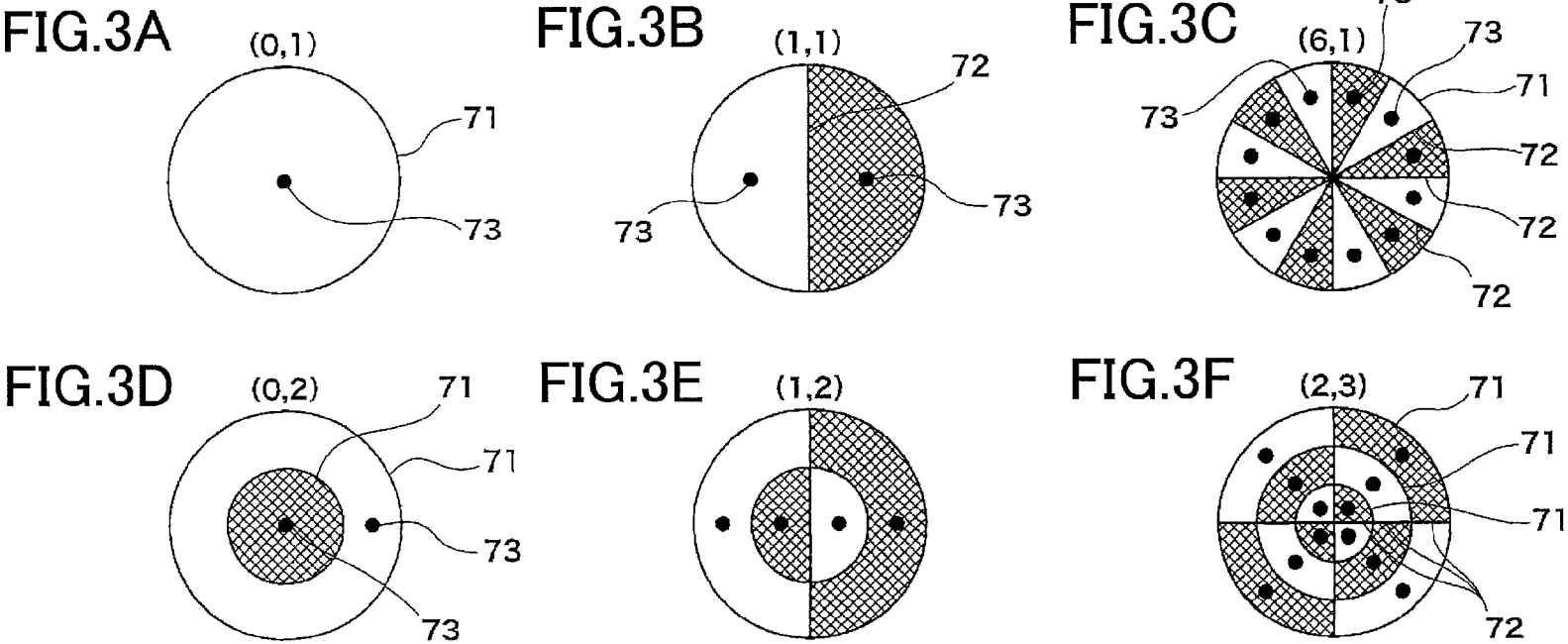
FIGS. 3A-3F are schematic views for explaining modes of membrane vibration of the drum.

A vibration mode differs depending upon the way to view nodal lines of vibration. The nodal lines of vibration include a nodal line 71 in the circumferential direction (circumferential nodal line 71) and a nodal line 72 in the diametrical direction (diametrical nodal line 72). A plurality of circumferential nodal lines 71 constitute concentric circles. For instance, as shown in FIG. 3A, the number of antinodes 73 is one in vibration relating to the nodal line 71 along the outer circumferential edge of the batter head 101. As shown in FIG. 3B, the number of antinodes 73 is two in vibration relating to the nodal line 71 along the outer circumferential edge of the batter head 101 and one diametrical nodal line 72. As shown in FIG. 3C, the number of antinodes 73 is twelve in vibration relating to the nodal line 71 along the outer circumferential edge of the batter head 101 and six diametrical nodal lines 72. As shown in FIG. 3D, the number of antinodes 73 is two in vibration relating to two circumferential nodal lines 71.

Here, a vibration mode (n, m) is defined as (the number n of diametrical nodal lines 72, the number m of circumferential nodal lines 71). The example of FIG. 3A is represented as a vibration mode (0, 1) which is the lowest-order mode. Similarly, the examples of FIG. 3B, FIG. 3C, FIG. 3D, FIG. 3E, FIG. 3F are respectively represented as a vibration mode (1, 1), a vibration mode (6, 1), a vibration mode (0, 2), a vibration mode (1, 2), and a vibration mode (2, 3). The larger the number of antinodes 73 in vibration, the higher the order of the vibration mode, so that vibration in higher frequencies occurs. Striking of the batter head 101 causes the vibrations in lower-order vibration modes and the vibrations in higher-order vibration modes to occur in parallel. This is true of the resonance head 102.

Figure 4A:
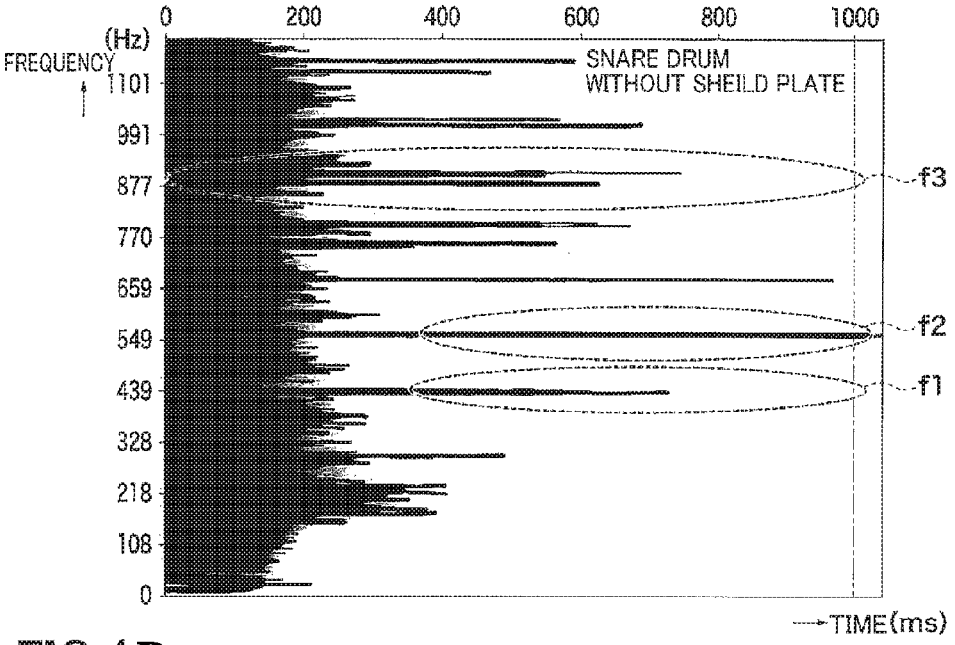
FIGS. 4A and 4B are views showing temporal changes of respective frequencies of vibration of the snare drum.
Figure 4B:
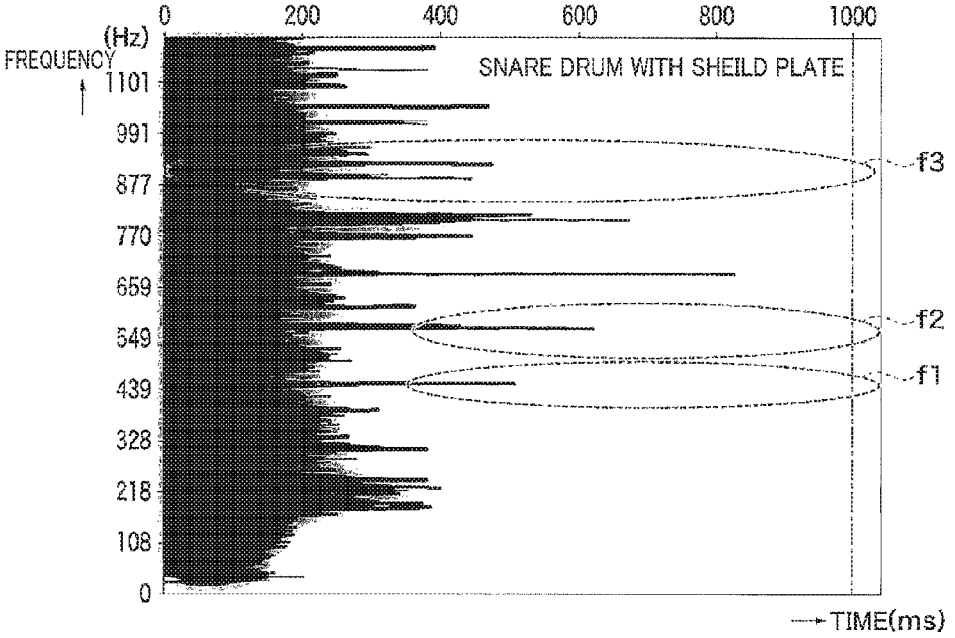

Each of FIGS. 4A and 4B shows temporal changes of respective frequencies of vibration of the snare drum 100. The graph of FIG. 4A shows data obtained in a conventional configuration without the vibration damping portion, and the graph of FIG. 4B shows data obtained in a configuration in which only the vibration damping portion 11 is provided. In the graphs of FIGS. 4A and 4B, the horizontal axis represents time (ms), and the vertical axis represents frequency (Hz).

In FIGS. 4A and 4B, the frequency ranges "f1", "f2", and "f3" represent relatively high frequency ranges, e.g., not lower than 400 Hz, (f1<f2<f3). Comparison between FIG. 4A and FIG. 4B reveals that, in all of the frequency ranges f1, f2, f3, vibration is attenuated earlier in the configuration having the vibration damping portion 11 than in the conventional configuration without the vibration damping portion 11.

Figure 5A:
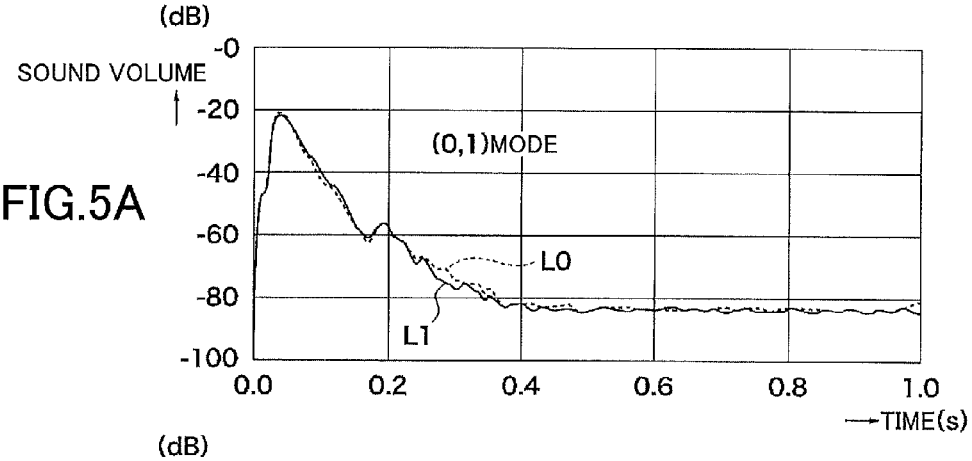
FIGS. 5A-5C are graphs each showing a temporal change in a sound volume level when the snare drum is struck.
Figure 5B:
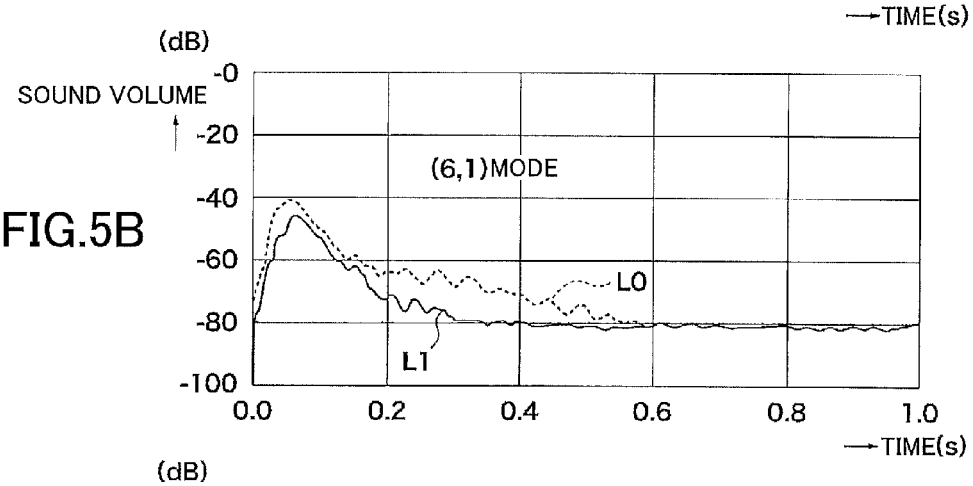
Figure 5C:
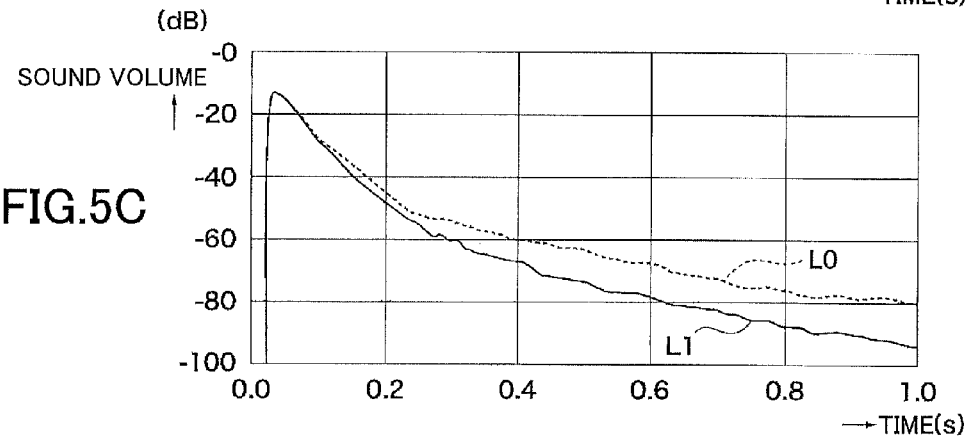

Each of FIGS. 5A, 5B, and 5C is a graph showing a temporal change in a sound volume level when the snare drum 100 is struck. The graph of FIG. 5A shows a change in the sound volume when vibration in the vibration mode (0, 1) is extracted, and the graph of FIG. 5B shows a change in the sound volume when vibration in the vibration mode (6, 1) is extracted. The graph of FIG. 5C shows a change in the sound volume when vibrations in all vibration modes are superimposed. In the graphs of FIGS. 5A-5C, a curve L0 represents a change in the sound volume in a snare drum 100 without having the vibration damping portion 11, and a curve L1 represents a change in the sound volume in the snare drum 100 having the vibration damping portion 11. In each graph, the vertical axis represents sound volume level (dB), and the horizontal axis represents time (s). The sound volume level is detected by a microphone or the like. In FIGS. 5A and 5B, only frequency components corresponding to the respective vibration modes are extracted by removing other frequency components other than the corresponding frequencies.

As apparent from FIG. 5C, the curve L1 attenuates earlier than the curve L0. Thus, the vibration damping portion 11 contributes to early attenuation of overall sound volume. In the vibration mode (0, 1), there is no distinct difference between the curve L0 and the curve L1 (FIG. 5A) whereas the curve L1 attenuates earlier than the curve L0 in the vibration mode (6, 1). It is thus to be understood that the vibration damping portion 11 does not exhibit a vibration damping effect so much with respect to the lower-order vibration mode but exhibits a vibration damping effect with respect to the higher-order vibration mode.

The effects exhibited by the vibration damping portion 11 are explained as a representative example. When the batter head 101 vibrates, air existing between the outer-surface facing surface 11*a* of the vibration damping portion 11 and the batter head 101 acts as a damper, so that the vibration damping effect is exhibited. As described above, the outer-surface facing surface 11*a* is located in the region corresponding to the outer peripheral portion of the batter head 101. As explained above with respect to FIG. 3, because it is considered that there are an infinite number of diametrical nodal lines 72, numerous antinodes 73 in the higher-order vibration mode exist in the outer peripheral portion of the batter head 101. Consequently, vibration is not sustained longer in the higher-order vibration mode, as compared with the lower-order vibration mode, so that vibration of the high-frequency component attenuates earlier and is effectively damped.

That is, the existence of the vibration damping portion 11, etc., prevents or reduces the so-called coupled vibration in which the batter head 101 and the resonance head 102 synchronously vibrate. In particular, discordant harmonic components attenuate early, so that tone color is improved. As the side benefit, unnecessary reverberations of membranes (the heads 101, 102) do not last, sound of the snare wire 97 attenuates early, so that crisp sound is obtained. The outer-surface facing surface 11*a* is not in contact with the batter head 101. Consequently, vibration is excited at the time of rise (attack) of the struck sound as it was conventionally excited, so that the sound at the time of rise does not become dull. It is thus possible to obtain rich harmonics at the time of rise without sacrificing the component that is the base of rich tone color.

According to the present embodiment, the high-frequency component of the struck sound is suppressed and the tone color is improved owing to provision of the vibration damping portions 11, 21 that are opposed to the batter head 101 and the vibration damping portions 31, 41 that are opposed to the resonance head 102, so that tone color is improved.

In the illustrated embodiment, the vibration damping portion is attached to the inner circumferential surfaces of the hoops 92, 93 and the inner circumferential surface of the cylindrical portion 91*c* of the shell 91. The vibration damping portion may be attached to any position as long as the vibration damping portion does not contact the surfaces of the batter head 101 and the resonance head 102. The vibration damping portion may be fixed by screwing or the like to component(s) disposed inside or outside the cylindrical portion 91*c*. For instance, the first member 10 having the vibration damping portion 11 may be attached to the lugs 96 or the tuning bolts of the lugs 96. Further, the vibration damping portion may be formed integrally with the cylindrical portion 91*c* or may be formed integrally with component(s) disposed inside or outside of the cylindrical portion 91*c*.

Referring to FIGS. 6-8, there will be explained various modifications. FIGS. 6A-6D are schematic plan views of vibration damping portions according to the modifications.

Figure 6A:
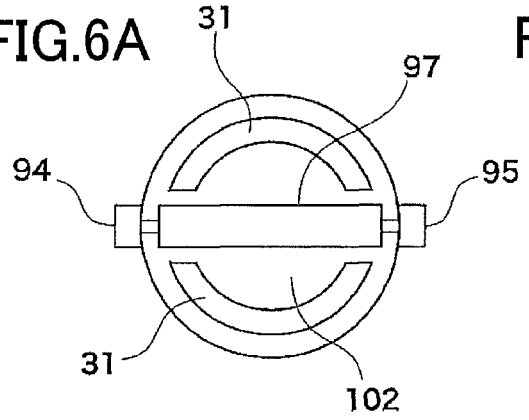
FIGS. 6A-6D are schematic plan views respectively showing vibration damping portions according to modifications.

As shown in FIG. 6A, the vibration damping portion 31 may be disposed so as to be divided into two parts and located in regions of the resonance head 102 in the circumferential direction, which regions do not include the positions of the pair of snare wire attachments 94, 95. According to the arrangement, the vibration damping portion 31 is opposed to the resonance head 102 so as to avoid the snare wire 97, so that the vibration of the snare wire 97 is less likely to be influenced. It is thus possible to obtain the sound of the snare wire 97 while the vibration of the resonance head 102 is damped. While the pair of snare wire attachments 94, 95 are illustrated, the pair of snare wire attachments 94, 95 may include a single snare wire attachment. The vibration damping portion 41 may be constructed similarly to the thus constructed vibration damping portion 31.

Figure 6B:
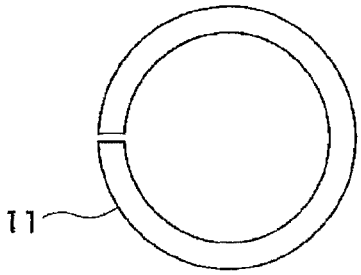
Figure 6C:
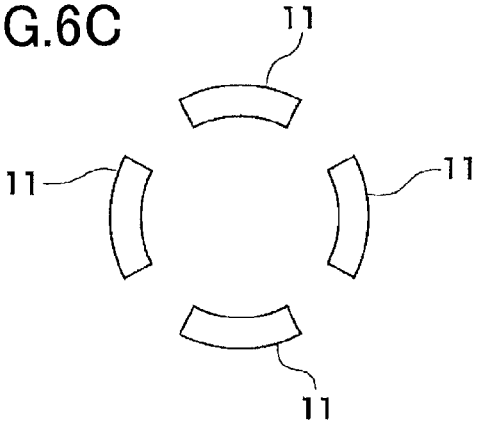
Figure 6D:
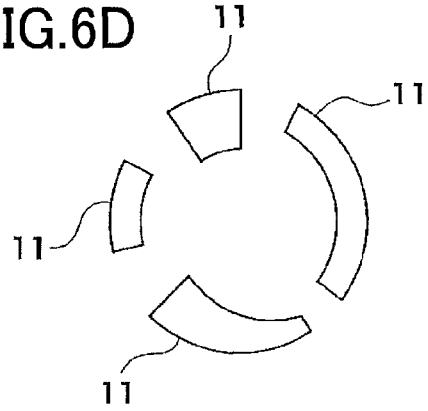

Each of the vibration damping portions described above need not necessarily have a continuous annular shape in plan view. As shown in FIGS. 6B-6D, the vibration damping portion may have an intermittent substantially annular shape. Explanation is made taking the vibration damping portion 11 as an example. In an instance where the vibration damping portion has an intermittent annular shape, it is needed to dispose the vibration damping portion 11 so as to extend in the circumferential direction at least over a distance not smaller than 1/10 of the circumference. The vibration damping portion 11 opposed to the same surface need not to be single, but may be divided into a plurality of parts as shown in FIGS. 6A, 6C, and 6D. The dimension of the vibration damping portion 11 in the radial direction, namely, the width of the vibration damping portion, need not be constant, but may change in the circumferential direction (FIG. 6D). Thus, each of the vibration damping portions 11 may have any shape in plan view, such as a fan-like shape and a rectangular shape. The high-frequency component is effectively suppressed by the vibration damping portion formed to have a continuous or intermittent substantially annular shape in plan view corresponding to the outer peripheral portion of the head.

Figure 7A:
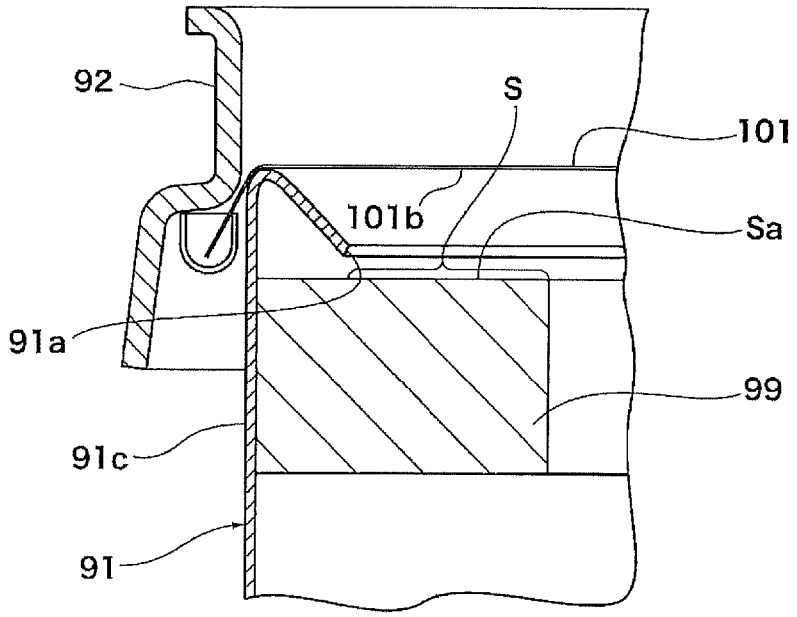
FIGS. 7A and 7B are fragmentary elevational views in vertical cross section respectively showing snare drums that employ vibration damping portions according to modifications.
Figure 7B:
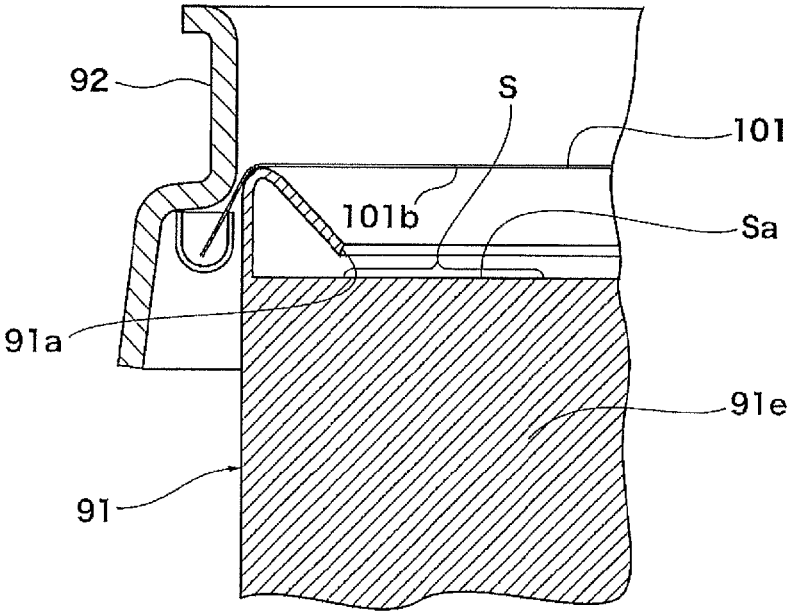

FIGS. 7A and 7B are fragmentary elevational views in vertical cross section respectively showing upper portions of the snare drums 100 that employ vibration damping portions according to modifications.

The vibration damping portion need not be shaped like a plate, but may be thick in the up-down direction as follows. As shown in FIG. 7A, an annular member 99 corresponding to the second member 20 is fixed to the inner circumferential surface of the cylindrical portion 91*c* of the shell 91. An upper surface of the annular member 99 functions as a vibration damping portion S corresponding to the vibration damping portion 21, and a part of the vibration damping portion S, which is opposed to the inner surface 101*b* of the outer peripheral portion of the batter head 101, functions as an inner-surface facing surface Sa corresponding to the inner-surface facing surface 21*a*.

As shown in FIG. 7B, a portion corresponding to the vibration damping portion 21 may be formed integrally with the cylindrical portion 91*c*. That is, the cylindrical portion 91*c* has a large thickness in the radial direction, so as to provide a thick-walled portion 91*e* formed integrally with the cylindrical portion 91*c*. In this arrangement, an upper surface of the cylindrical portion 91*c* functions as a vibration damping portion S corresponding to the vibration damping portion 21, and a part of the vibration damping portion S, which is opposed to the inner surface 101*b* of the outer peripheral portion of the batter head 101, functions as an inner-surface facing surface Sa corresponding to the inner-surface facing surface 21*a*. The thick-walled portion 91*e* may be formed so as to continuously extend near to the resonance head 102, and a lower surface of the thick-walled portion 91*e* may have a function corresponding to the vibration damping portion 41 and the inner-surface facing surface 41*a*.

Figure 8A:
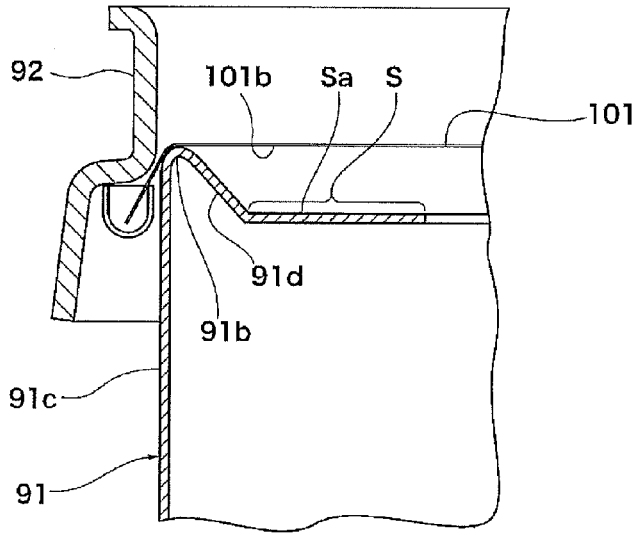
FIG. 8A is a fragmentary elevational view in vertical cross section of an upper portion of a snare drum that employs a vibration damping portion according to a modification and FIG. 8B is a perspective view of a shell of the snare drum shown in FIG. 8A.
Figure 8B:
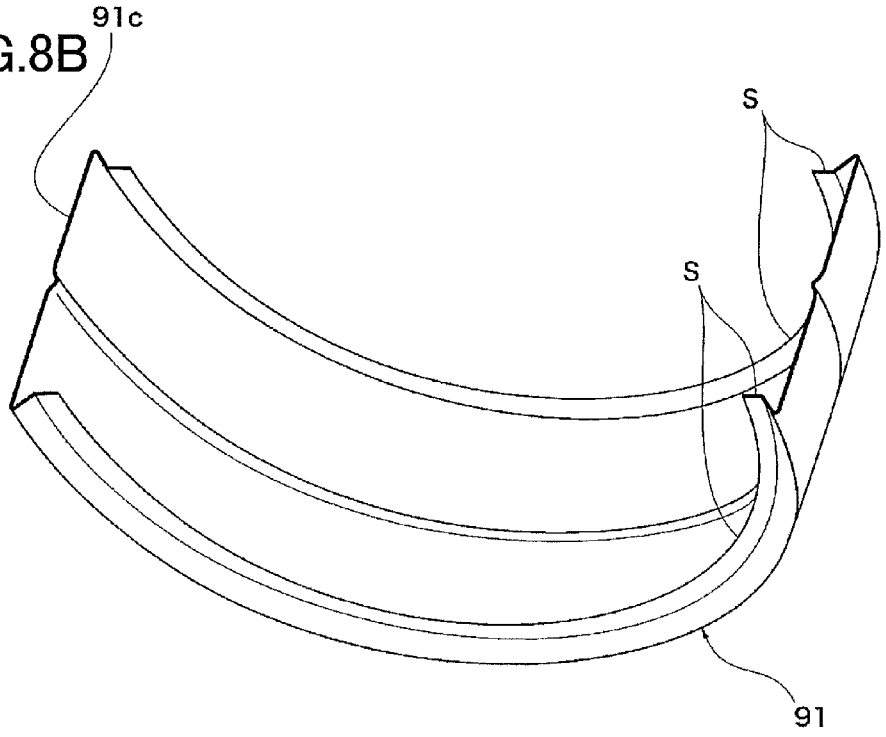

FIG. 8A is a fragmentary elevational view in vertical cross section showing an upper portion of the snare drum 100 that employs a vibration damping portion according to a modification. FIG. 8B is a perspective view of the shell 91 of the snare drum 100 shown in FIG. 8A.

As shown in FIG. 8A, a vibration damping portion S corresponding to the vibration damping portion 21 is formed integrally with the shell 91. That is, an upper open end of the cylindrical portion 91*c* is bent inward at the bent portion 91*b*, and a horizontal portion, which extends horizontally from a distal end of an inclined portion 91*d* extending obliquely downward, functions as the vibration damping portion S corresponding to the vibration damping portion 21. A part of the vibration damping portion S, which is opposed to the inner surface 101*b* of the outer peripheral portion of the batter head 101, functions as an inner-surface facing surface Sa corresponding to the inner-surface facing surface 21*a*. A lower portion of the cylindrical portion 91*c* is similarly formed in vertically symmetrical relation to the upper portion thereof. Thus, a vibration damping portion S corresponding to the vibration damping portion 41 is formed as shown in FIG. 8B. In this instance, the shell 91 is formed of metal, for instance, and is easily produced by a work of bending upper and lower ends of the shell 91. The construction of FIGS. 8A and 8B reduces the number of required components and facilitates formation of the vibration damping portions, resulting in a reduction in the production cost. The shell 91 may be formed of any material other than metal as long as the shell 91 can be formed to have the bent shape. For instance, the bent shape of the shell 91 may be obtained by bending or cutting a wooden plate or a resin plate, for instance.

In the configurations explained above, the vibration damping portions are provided at four positions, i.e., the front and the back of the batter head 101 and the front and the back of the resonance head 102, for enhancing the effect of suppressing the high-frequency component of the struck sound. The vibration damping portion may be provided at least one of the four positions. For instance, the vibration damping portions may be provided at the front and the back of the batter head 101, and no vibration damping portion may be provided for the resonance head 102. Provision of the vibration damping portions for the batter head 101 ensures a higher effect than provision of the vibration damping portions for the resonance head 102. However, only the vibration damping portions for the resonance head 102 may be provided.

It is noted that the principle of the present invention is applicable to not only the snare drum, but also various drums such as a tom-tom, a bass drum, a concert bass drum, and a timpani. In a drum not having the resonance head, the vibration damping portion for the batter head is provided. The present invention is applicable to a drum having a striking surface on the back side of the batter head, namely, a drum in which an inner surface of the batter head is a striking surface.

While the preferred embodiments of the present invention have been described in detail, it is to be understood that the present invention is not limited to the details of the embodiments and that various forms within the scope of the invention are included in the present invention. The modifications may be partly combined.

EXPLANATION OF REFERENCE SIGNS

10: first member 20: second member 30: third member 40: fourth member 11, 21, 31, 41, S: vibration damping portion 11*a*, 31*a*: outer-surface facing surface 21*a*, 41*a*, Sa: inner-surface facing surface 91: shell 91*b*: bent portion 91*c*: cylindrical portion 94, 95: snare wire attachment 97: snare wire 101: batter head 101*a*, 102*a*: outer surface 101*b*, 102*b*: inner surface 102: resonance head

The invention claimed is:

1. A drum comprising:

a shell;

at least one head having an outer peripheral portion with an outer surface and an inner surface opposite the outer surface;

a first vibration damping portion including an outer-surface facing surface disposed substantially parallel with and closely opposed to the outer surface of the at least one head without any member contacting both the outer-surface facing surface and the outer surface; and a second vibration damping portion including an inner-surface facing surface disposed substantially parallel with and opposed to the inner surface of the at least one head without interposing any member contacting both the inner-surface facing surface and the inner surface.

2. The drum according to claim 1, wherein one of the at least one head is a resonance head, and the first or second vibration damping portion is provided for the outer peripheral portion of the resonance head.

3. The drum according to claim 2, further comprising:

an attachment provided on the shell for attaching a snare wire, wherein the second vibration damping portion is provided for the resonance head and is located in a region of the resonance head in its circumferential direction, which region does not include a position of the snare wire in a state where the snare wire is attached to the attachment.

4. The drum according to claim 1, wherein:

one of the at least one head is a batter head, and the first or second vibration damping portion is provided for the outer peripheral portion of the batter head.

5. The drum according to claim 1, wherein:

the shell includes an opening at one end portion thereof and a bent portion provided at the one end portion, the inner-surface facing surface is provided at the bent portion of the shell.

6. The drum according to claim 1, wherein the first or second vibration damping portion has a continuous or intermittent substantially annular shape in a plan view.

7. The drum according to claim 1, wherein the inner-surface facing surface of the second vibration damping portion is opposed to the inner surface of the outer peripheral portion of the at least one head at a position located radially inward of a distal end of an opening portion of the shell that defines an opening of the shell.

8. A drum comprising:

a shell;

at least one head having an outer peripheral portion with an outer surface and an inner surface opposite the outer surface;

a first vibration damping portion including an outer-surface facing surface disposed substantially parallel with and closely opposed to the outer surface of the at least one head without contacting the outer surface;

a second vibration damping portion including an inner-surface facing surface disposed substantially parallel with and opposed to the inner surface of the at least one head without contacting the inner surface; and a support member supporting each of the first and second vibration damping portions at a supporting position that is disposed spaced from the least one head.

* * * * *